United States Patent [19]

Hanyu et al.

[11] Patent Number: 4,702,185

[45] Date of Patent: Oct. 27, 1987

[54] SEWING MACHINE WITH AN AUTOMATIC THREAD TENSION DEVICE

[75] Inventors: Susumu Hanyu; Nobou Kasuga, both of Tokyo; Kazumasa Hara, Hino; Mikio Koike, Oume, all of Japan

[73] Assignee: Janome Sewing Machine Co., Ltd., Tokyo, Japan

[21] Appl. No.: 880,004

[22] Filed: Jun. 30, 1986

[30] Foreign Application Priority Data

Jun. 28, 1985 [JP] Japan ..... 60-140171

[51] Int. Cl.[4] ..... D05B 47/04

[52] U.S. Cl. ..... 112/254; 112/453

[58] Field of Search ..... 112/254, 255, 453, 456, 112/458, 121.11, 229, 228, 230, 231

[56] References Cited

U.S. PATENT DOCUMENTS 4,301,757 11/1981 Tonomura ..... 112/254

4,377,980 3/1983 Hanyu et al. ..... 112/254

4,466,368 8/1984 Hanyu et al. ..... 112/254 X

*Primary Examiner*—Peter Nerbun

*Attorney, Agent, or Firm*—Michael J. Striker

[57] ABSTRACT

This invention makes a proper calculation to an amount of supplying a lower thread to be required to forming of a stitch with stitching information in relation with changing of a needle dropping position from a preceding stitch to a present stitching, so that the lower thread is forcibly drawn out in accordance with said calculation, and makes a proper calculation to tension of an upper thread optimum to forming of a stitch with stitching information so as to determine the optimum upper thread tension in accordance with said calculation, or makes a calculation to the amount of supplying the upper thread optimum to forming of a stitch with stitching information so as to draw out the upper thread in accordance with said calculation.

6 Claims, 23 Drawing Figures

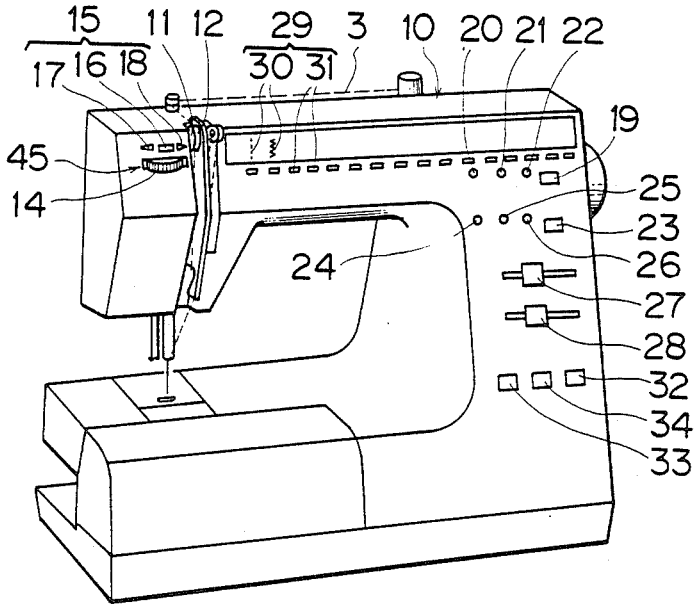
FIG_9
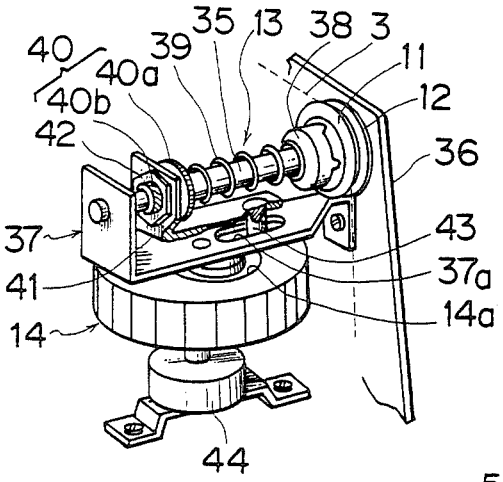
FIG_10
FIG_11
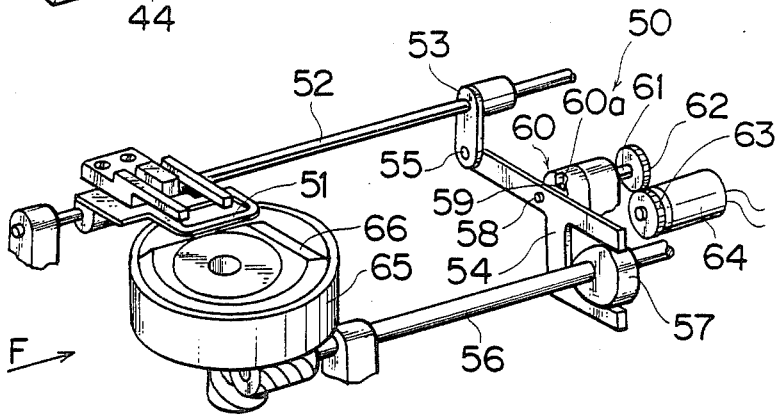

SEWING MACHINE WITH AN AUTOMATIC THREAD TENSION DEVICE

FIELD OF THE INVENTION

The present invention relates to a sewing machine with an automatic thread tension device which determines an interlocking position of a stitch, i.e., an interlocking position of upper and lower threads at an optimum position or a position which does not interfer with practical operations, as well as forms stitches in response to usage, for example, without shrinkage of stitching or with desirous thread tightening.

BACKGROUND OF THE INVENTION

As the prior art for providing automatically thread tension, a method is known which controls tension to an upper thread, and another method is known which controls an amount of upper thread supplied. With respect to these methods, various proposals have been made; however, there have not been any satisfactory measures provided to handle shrinkages of a zigzag stitch on thin fabrics.

SUMMARY OF THE INVENTION

This invention makes an appropriate calculation of an amount of lower thread to be supplied which is required to form a stitch based on stitching information relative to a changing of a needle so that the lower thread is forcibly drawn out in accordance with said calculation. The invention makes a calculation for tensioning to an upper thread optimum to form a stitch based on stitching information so as to determine the optimum upper thread tension in accordance with said calculation, or makes a calculation for supplying the optimum amount of upper thread to form a stitch based on stitching information so as to draw out the upper thread in accordance with said calculation.

The stitch of a desired thread tension tightening is formed automatically for normal fabrics, and a force effected for tightening of a stitch is moderated for thin fabrics.

Thus, the stitches' desired thread tension may be formed automatically without causing shrinkage.

BRIEF DESCRIPTION OF THE DRAWINGS

FIGS. 9 and 10 relate to a first embodiment of the invention. FIG. 9 is a perspective view of a sewing machine. FIG. 10 is a perspective view of an upper thread tension device;

FIGS. 11 and 12 relates to a preferred embodiment of a mechanism of drawing out the lower thread, which is common to the first embodiment and a second and third embodiments, and FIG. 11 is a perspective view of a lower thread drawing-out mechanism, and FIG. 12 is a cross sectional view seen from an arrow F of FIG. 11;

FIG. 13 is a perspective view of a lower thread drawing-out mechanism, FIG. 14 is a view showing a roller of a follower and its carriage and FIG. 15 is a cross sectional view seen from an arrow G of FIG. 13;

FIG. 16 is a perspective view of a lower thread drawing-out mechanism, FIG. 17 is a perspective view of a lower thread supplier and FIG. 18 is a cross sectional view as seen from an arrow H of FIG. 16;

FIG. 19 is a perspective view of a sewing machine, FIG. 20 is a perspective view of an upper thread controller, and FIG. 21 is a diagram showing a relation between a curve showing the amount of loosening the upper thread by a take-up lever for a phase of an upper shaft of the sewing machine and a curve showing the amount of supply of an upper thread required by only "X"; FIG. 22 is a perspective of the sewing machine and FIG. 23 is a perspective view of an upper thread controller.

DETAILED DESCRIPTION OF PREFERRED EMBODIMENTS OF THE INVENTION

An explanation will be made to a calculation of an amount of lower thread to draw.

In this invention, a time to draw out the lower thread for forming a present stitch is after a preceding stitch has been formed. Therefore, each cycle for forming the stitches is from when an amplitude is effected to a needle and a stitch is formed until a feed is finished.

Figure 1:
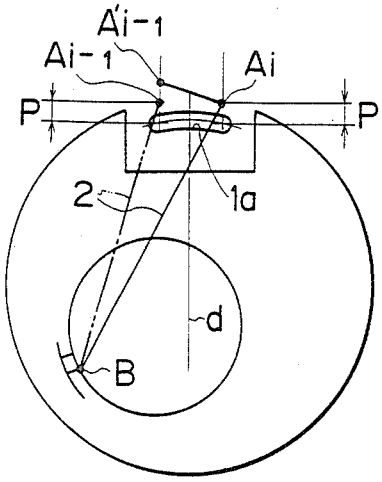
FIGS. 1 and 2 are plan views showing paths of a lower thread, which indicates the amount of lower thread being drawn out.
Figure 2:
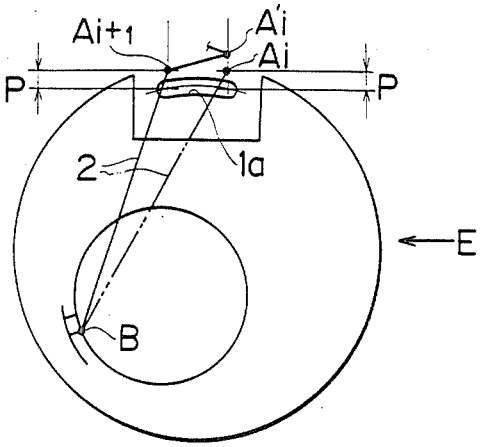

As shown in FIGS. 1 and 2, of generally a horizontal loop taker, a point B drawn out from a bobbin carrier in a horizontal projection is biased to a left side in most cases including also the instant embodiment, with respect to a segment d running through a center of a needle hole 1*a* formed in a needle plate along a feed direction.

When a calculation is made of the amount drawn out of the lower thread from the horizontal loop taker, it is insufficient to add simply, as calculation of the amount drawn out of the upper thread, a length to be determined by a thickness of a fabric and an interlocking position to the length of the upper thread from the preceding stitch to the present one, and make correction thereafter. Attention should be paid to changes in a path of the lower thread running from a starting point to a stitch forming position.

An explanation will be made to an example when the zigzag stitching is carried out at the maximum amplitude and constant feeding amount P with reference to FIGS. 1 and 2. In FIG. 1, assume that a stitch of the preceding left basic line is Ai−1 (feed amount P) and a stitch of the present right basic line is Ai (feed amount P), and a lower thread supply point is B. If a comparison in made between a path Ai−1 B and a path Ai B in a horizontal projection from the lower thread supply point B, a result will be Ai−1 B<Ai B.

Therefore, when the fabric thickness is 0, the lower thread supply amount required for forming the stitch Ai is larger than Ai−1 Ai.

Herein, A'i−1 in FIG. 1 designates a position of the preceding stitch Ai−1 on the fabric after the present stitch has been formed.

In FIG. 2, with respect to the present stitch Ai of the right basic line (feed amount P) and a subsequent stitch Ai+1 of the left basic line (feed amount P), if the path Ai B and the path Ai+1 B are compared, Ai B<Ai+1 B. Therefore, when the fabric thickness is 0, the lower thread supply amount required for forming the stitch Ai+1 is smaller than A'i Ai+1.

Herein, A'1 designates a position of the present stitch Ai on the fabric after a subsequent stitch has been formed.

Figure 3:
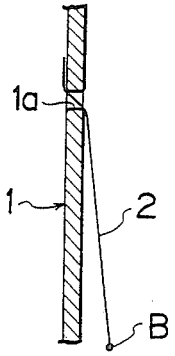
FIG. 3 is a cross sectional view as seen from an arrow E of FIG. 2.

The lower thread supply point B is, as seen in FIGS. 1 and 2, biased toward the left side with respect to the line d running through the center of the needle hole 1*a*, and this point B is, as seen in FIG. 3, positioned at the lower part of the needle plate 1. Therefore, the path of the lower thread 2 is three-dimensional and bent at the hole 1*a*. Thus, the actual path length of the lower thread with respect to the stitch formed by each of the needle droppings, is more or less larger than the length of the lower thread shown with the horizontal projections in FIGS. 1 and 2.

Figure 7:
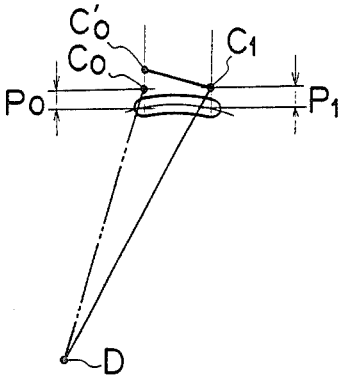
FIGS. 7 and 8 are diagrams of the lower thread position of FIGS. 1 and 2 respectively, indicative of the amount of lower thread drawn out.
Figure 8:
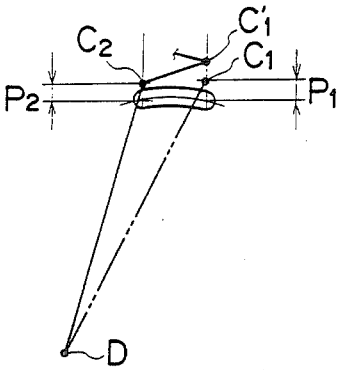

In FIGS. 7 and 8, D is an imaginary point of drawing out the lower thread on a plane surface, which is formed in the fabric by a stitch of the lower thread on the needle plate. With respect to the point D, the actual length of the lower thread path is obtained for forming the stitch, and the point D is an interlocking point (actually interlocking at one point).

A further explanation will be made to calculation of the lower thread supply amount with reference to FIG. 7.

Assuming that

C0: preceding stitch (feed amount P0)

C1: present stitch (feed amount P1)

C'0: position of the preceding stitch on a fabric after the present stitch has been formed $\alpha$: Interlocking supply amount $\beta$: tightening amount for interlocking, the lower thread supply amount X1 to be required for forming a present stitch C1 is $$X1 = C'0\ C1 + C1\ D - C0\ D + \alpha - \beta \quad \text{(a)}$$

An interlocking supply amount $\alpha$ due to the relationship between the upper and the lower threads controls the consumed amount of lower thread to be required to interlock with the upper thread from the needle dropping position of the instant stitch at the lower surface of the fabric, and it will be plus or minus by the interlocking relation with the upper thread.

Figure 4:
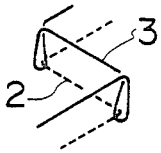
FIGS. 4 through 6 are perspective views showing interlockings of the the upper and lower threads.
Figure 5:
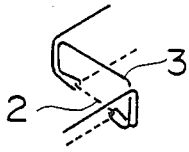
Figure 6:
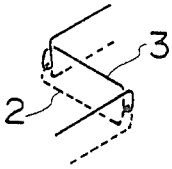

That is to say, when the upper thread 3 and the lower thread 2 are interlocked at the lower surface of the fabric (not shown) as shown in FIG. 4, said amount is 0. When the lower thread 2 pulls the upper thread 3 to the lower surface of the fabric and the interlocking is made there as shown in FIG. 5, the amount is a minus value. When the interlocking is made in the center of the fabric, it is a plus value.

When the interlocking is made with a very weak force, a tightening amount $\beta$ therefore is set to 0. When the former is made with a moderate force, the latter is set at a value of plus.

Assume that an amount of lower thread to be consumed to form a stitch by interlocking with the upper thread at a predetermined position is a predetermined consuming amount. If the lower thread supply amount by a lower thread supply mechanism agrees with the predetermined consumption by setting the tightening amount $\beta$ to 0, both threads are interlocked with a very weak tightening. If the thread tightening amount $\beta$ is set at one of the plus values so as to draw out the threads less than the amount of predetermined consumption, the lower thread is drawn out by its slacking amount under tension from the bobbin carrier, not depending upon the lower thread supply mechanism, whereby the upper and the lower threads are interlocked at the moderate tightening force.

Referring to (a) equation and FIG. 7 C1 D>C0 D and assuming that the supply amount $\alpha$ is 0 and the tightening amount $\beta$ is 0, X1 is a larger value than C'0 C1.

In FIG. 8, assuming that

C1: present stitch (feed amount P)

C2: subsequent stitch (feed amount P)

C'1: position of the present stitch on the fabric after the subsequent stitch C2 has been formed, the lower thread supply amount X2 to be required for forming the subsequent supply amount is $$X2 = C'1\ C2 + C2\ D - C1\ D + \alpha - \beta \quad \text{(b).}$$

Referring to the (b) equation and FIG. 8, C2 D<C1 D, and assuming that the supply amount $\alpha$ is 0 and the tightening amount $\beta$ is 0, X2 is a smaller value than C'1 C2.

As is seen from the equations (a) and (b), the lower thread supply amount Xi to be required to form the i stitching is expressed with $$Xi = C'i-1\ Ci + Ci\ D - Ci-1\ D + \alpha - \beta \quad \text{(c)}$$

Herein,

Ci−1: stitch of the i−1 stitching

Ci: stitch of the i stitching

C'i−1: position of the i−1 stitching on the fabric after the stitch of the i stitching has been formed.

$\alpha$: supply amount $\beta$: tightening amount

In equation (c), the position of the lower thread supply point D to the needle dropping hole 1*a* can be obtained. Therefore each of terms except $\alpha$ and $\beta$ of the equation (c) is determined by the fabric feed amount and the needle amplitude amount of the i stitching and the i−1 stitching which are actuated by later mentioned feed amount signal, amplitude amount signal and pattern stitching signal. Since $\alpha$ is determined by a relation between a fabric thickness and an interlocking position and $\beta$ is determined by a fabric sort signal, and if calculation program based on the equation (c) is in advance stored in a memory of a computer installed in the sewing machine, the lower thread supply amount to be required to form stites can be calculated.

Embodiment 1

The present invention will referred to with a 1st embodiment.

In FIG. 9, a sewing machine 10 has an upper thread tension device 13 with a pair of thread tension discs 11 and 12, and an upper thread 3 from a thread supply is effected with tension by the upper thread tension device 13.

14 designates a thread tension dial of the device 13, and 15 designates a thread tension indicator comprising a central LED 16 and right and left LEDs 17,18 shaped as arrows. Said thread tension device 13 and said indicator 15 constitute an upper thread control mechanism 45.

19 designates a fabric sort input button. "Thin", "Medium" and "Thick" are cyclically selected by a pushing operation, and when a fabric sort signal is input, a corresponding LED 20, 21 or 22 is lighted.

23 is a thread sort input button, "#100", "#50", and "#30" are cyclically selected a pushing operation, and when a thread sort signal is input, a corresponding LED 24, 25 or 26 is lighted.

27 is a fabric feed control lever, and a fabric feed signal is entered as input by a sliding operation. 28 is a needle amplitude control lever, and a needle amplitude signal is entered as input by a sliding operation.

29 is a pattern selection part having pattern indicators 30 and a plurality of pattern selecting buttons 31 corresponding to said pattern indicators 30. A pattern is selected by the operation of the pattern selecting button 31, and simultaneously the pattern signal is input.

32 is a manual button. If button 33 is pushed after having pushed said manual button 32, a stitch of interlocking as shown in FIG. 4 is selected. If the button 34 is pushed, a stitch of interlocking as shown in FIG. 5 is selected, thereby saving the consuming amount of the lower thread. If the manual button 32 is pushed, the manual mode is released.

Referring to FIG. 10, an explanation will be made to the upper thread tension device 13 of the upper thread control mechanism 45. A thread tension shaft 35 is secured at its one end to a base 36 fixed to the machine frame and is supported at its other end to a support plate 37 integrate with said base 36.

The thread tension shaft 35 is mounted with the thread tension discs 11, 12 for holding the upper thread 3 therebetween, a presser 38, a spring 39 and a slider 40. A flange 40*a* of the slider 40 is contacted to the end of the spring 39, and a male screw 40*b* is formed on an outer circumference thereof. The male screw 40*b* is in mesh with a female screw (not shown) of an actuating plate 41, and is checked from its loosening by a nut 42.

A pin 43 is implanted to an actuation plate 41 and passes through an oblong groove 37*a* formed in a support plate 37 and is engaged with a groove cam 14*a* formed in the thread tension dial 14. The slider 40 is moved along the thread tension device shaft 35 to control the pressure between the thread tension discs 11, 12 by the spring 39. 44 is a volume which detects rotation position of the thread tension dial 14.

The rotation position of the thread tension dial 14 is detected by the volume 44. Stitching information is composed of said fabric sort signal, thread sort signal, fabric feed amount signal, needle amplitude amount signal and pattern stitching signal. The rotation position of the thread tension dial 14 is calculated by a program for the upper thread tension, said program having been in advance stored in a memory of a micro-computer incorporated in the sewing machine. In addition to said stitching information, a comparison is made to the rotation position of the dial 14 and the present position thereof on a ground of a later mentioned information about a lower thread supply amount. If the both coincide with each other, LED 16 of the indicator 15 is lighted, and if they do not coincide, either of LED 17 or 18 shaped in arrow is lighted and indicates a direction of rotation to be corrected.

When "Thin" is input by the fabric sort button 19, the program for the upper thread tension calculates a comparatively weak tension of the upper thread, to interlock with the lower thread which has been drawn out at the thread tightening amount $\beta$ being 0. When "Medium" and "Thick" are input, the program calculates a comparatively strong tension of the upper thread, to further draw out the lower thread which has been drawn out at the thread tightening amount $\beta$ being a plus value.

The lower thread supply mechanism will be explained with reference to FIGS. 11 and 12. A lower thread supplier 51 of said mechanism 50 is secured to a shaft 52 and turnable therearound. An arm 53 is fixedly mounted on the shaft 52, and is pivoted with a fork 54 via a pin 55, and the fork 54 is turned around the pin 55 by a triangle cam 57 mounted on a lower shaft 56 by a drive part of the sewing machine. A member 59 is pivoted by a pin 58 positioned nearly to a center of the form 54 and slid within a groove 60*a* of a controller 60 to slide the arm 53.

The controller 60 is adjusted in its obliquity by a stepping motor 64 serving as an adjusting actuator via a shaft 61, a gear 62 and a further gear 63. Thus, since the lower thread supply mechanism 50 is driven by a driving part of the sewing machine, said stepping motor 64 for controlling the amount of supplying the lower thread may be reduced in size and the lower thread supply mechanism 50 may be reduced in size accordingly.

Figure 12:
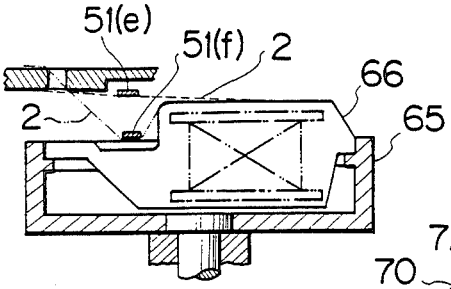

The lower thread supplier 51 is positioned between the loop taker 65, the bobbin carrier 66 and the needle plate 1, and as shown in FIG. 12 it is actuated from non-actuating position (e) to a maximum actuating position (f) so as to control the supply amount of the lower thread 2.

The supply amount of lower thread is controlled in accordance with the result of the calculation. In the present embodiment, such a supply amount is controlled as to form stitches at the weak tightening with respect to the thin fabric in the relation to said upper thread tension.

Figure 13:
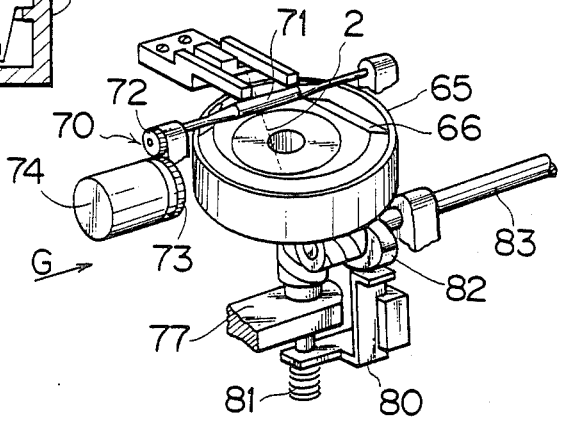
FIGS. 13 through 15 relate to another embodiment.
Figure 15:
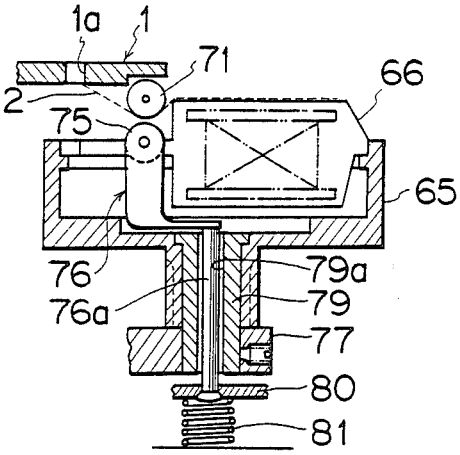
Figure 14:
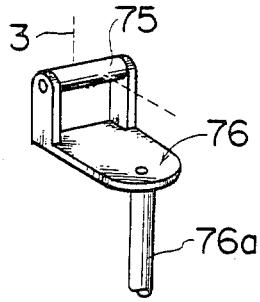

A further lower thread supply mechanism will be explained with reference to FIGS. 13 to 15, which is different from the mechanism shown in FIGS. 11 and 12. A lower thread supply mechanism 70 has a roller 71 at a driving side serving as a lower thread supplier, and the roller 71 is rotated by a stepping motor 74 serving as a control actuator via gears 72 and 73, and is actuated when a roller 75 of a follower comes closely. The roller 75 is rotatably mounted on a supporter 76 having a shaft 76*a* which passes through a hollow part 79*a* of a pivot pin 79 of a loop taker 65 secured to a fixture 77 and reaches at its lower end to an actuating plate 80.

The actuating plate 80 is biased upwardly by a spring 81, and closely brings the roller 75 to the roller 71 at an interval of lower thread supply phases by a cam 82 secured to a lower shaft 83, and controls the lower thread supply amount by rotation of the roller 75 by controlling the stepping motor 74, and in the meantime a loop of the upper thread caught by a hook of the loop taker 78 goes round a bobbin carier 66. The lower thread supply amount is controlled in the same manner as the lower thread supply mechanism 56 as shown in FIGS. 11 and 12.

Figure 17:
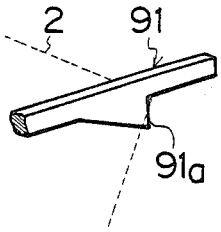
Figure 18:
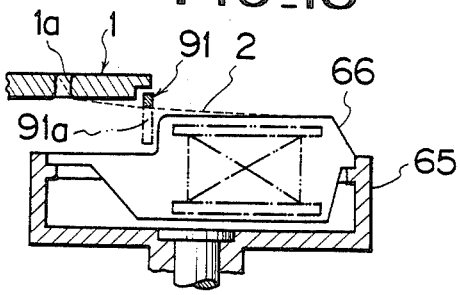

A still further lower thread supply mechanism will be explained with reference to FIGS. 16 to 18, which is different from the mechanism shown in FIGS. 13 to 15.

A lower thread supply mechanism 90 has a lower thread supplier 91 which is laterally slidable with respect to the machine frame and has a projection 91*a* for drawing out the lower thread. A groove 91*b* is engaged with a pin 92*a* of a follower arm 92. The follower arm 92 is rotatably mounted on the same output shaft as an actuating arm 94 and is connected to the arm 94 via a spring 95 which checks disorder to the stepping motor 93, for example when a disordering operation is caused such as the lower thread becomes twisted about the lower thread supplier 91.

Figure 16:
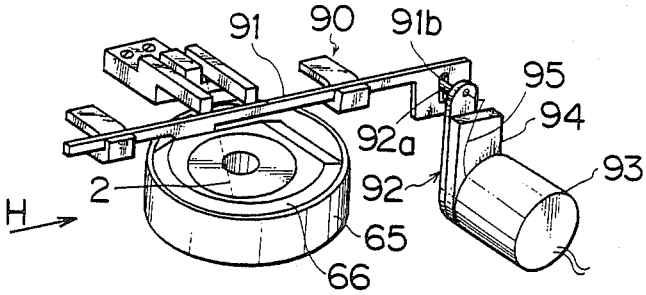
FIGS. 16 through 18 relate to a further embodiment.

The lower thread supplier 91 is moved to the right from a position shown in FIG. 16 by controlling the stepping motor 93, and draws out the lower thread 2 by bending the path of the lower thread 2 by said projection 91*a*. The lower thread supply amount is controlled in the same manner as the lower thread supply mechanism 50 as shown in FIGS. 11 and 12.

(Explanation of actuation)

The 1st embodiment of the invention will be explained. In FIG. 9, the sewing machine is set with the upper thread, the lower thread and a fabric for a sewing operation, and operated are the pattern selecting button 31, fabric sort input button 19, thread sort input button 23, fabric feed amount control lever 27 and needle amplitude amount control lever 28. Then, the sewing machine 10 is input with the stitching information made of the stitching pattern signal, fabric sort signal, thread sort signal, fabric feed amount signal, and needle amplitude amount signal. Then, a comparison is made to a rotating position and the present position of the thread tension dial 14 for the upper thread tension which has been calculated by the program in advance stored in the memory of the micro-computer. If both positions agree with each other, LED 16 is lighted, andif not agreeing, either of LED 17 or LED 18 is lighted. In the latter case, the thread tension dial 14 is rotated in accordance with the indication until LED 16 is lighted, whereby the most suited upper thread tension may be set.

When the sewing operation is started, the lower thread 2 is calculated with respect to the supply amount per each of stitches prior to forming the stitches, and the lower thread supply mechanisms 50, 70 or 90 is controlled in accordance with the calculation, and the stitches of automatic thread tension are formed successively.

In this embodiment, when "Thin" is input by the fabric sort input button 19, the upper thread tension is calculated at the comparatively weak value. The lower thread supply amount is calculated in the formula (c) so that the thread tightening amount $\beta$ is 0, and the upper and lower threads are interlocked with weak tightening. Thus, the stitches may be formed without causing shrinkages.

When the manual 33 is pushed and subsequently the button 32 is pushed, the lower thread supply amount is calculated in the formula (c) so that $\alpha$ is one of the minus values, and the upper and the lower threads are interlocked as seen in FIG. 4, and when the button 34 is pushed, the lower thread supply amount is calculated in the formula (c) so that the interlocking amount $\alpha$ is 0, and the upper and the lower threads are interlocked as seen in FIG. 5.

With respect to the stitch which requires the thread tightening firmly to a certain extent by the stitching information (for example, "Medium" or "Thick" is input by the fabric sort input button (19), the upper thread tension is calculated at the comparatively strong value, and the lower thread supply amount is calculated in the formula (c) so that the thread tightening amount $\beta$ is one of the plus values. While the lower thread is drawn out to a predetermined position in relation with the upper thread tension and the stitches are formed, as lacking amount of the lower thread is drawn out under a condition effecting the lower thread tension. and the stitches are formed under a condition that the tightening is sufficient to a certain extent.

(2nd embodiment)

Figure 19:
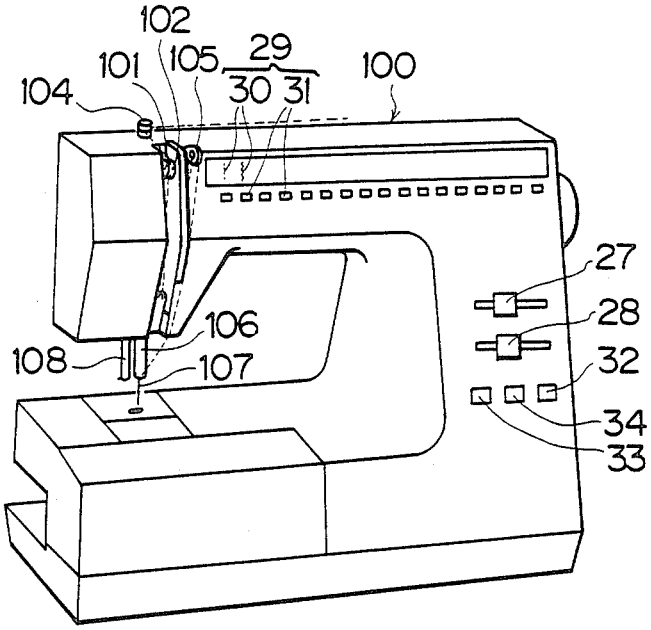
FIGS. 19 through 21 relate to a second embodiment.

A 2nd embodiment will be explained. In FIG. 19, a sewing machine 100 is incorporated with an upper thread control mechanism 103 having a fixed disc 101 and a movable disc 102, and the upper thread 3 from a thread supply is guided to a needle 107 held to a needle bar 106 via a pretension 10, a thread catching spring of said mechanism 103, a take-up lever 105 and others.

A numeral 27 is a fabric feed amount control lever, and is input with the fabric feed amount signal by the sliding operation. 28 is a needle amplitude amount control lever, and it is input with the needle amplitude amount signal by the sliding operation. 29 is a pattern selecting part having a pattern indicator 30 and a plurality of pattern selecting buttons 31. A stitching pattern is selected by the operation of the button 31, and at the same time a stitching pattern signal is input. 32 is a manual button, and if the button 31 is pushed after the manual button, the stitches of interlocking as seen in FIG. 4 are selected. If the button 34 is pushed, the stitches of interlocking in FIG. 5 are selected, so that the lower thread is saved. If the manual button 32 is again pushed, it is cancelled.

The sewing machine 100 is provided with a known fabric thickness detector which, though not shown, detects the fabric thickness by controlling a presser bar 108, and when the fabric is set on the sewing machine, the fabric sort signal is input.

Figure 20:
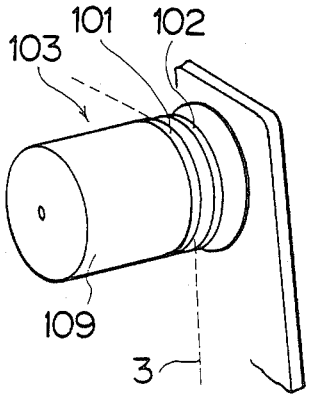

The upper thread control mechanism 103 has, as seen in FIG. 20, the fixed disc 101 and the movable disc 102, said fixed disc 101 being integral with a housing 109 provided to the machine frame, and said movable disc 102 being pressed to the fixed disc 101 against the spring when an electromagnet within the housing 109 is actuated. Said mechanism 103 is inoperative when the electromagnet is positioned at an interval of a certain phase of the stitching cycle of the sewing machine, and the movable disc 102 is separated from the fixed disc 101 by the spring, and releases the upper thread 3.

Figure 21:
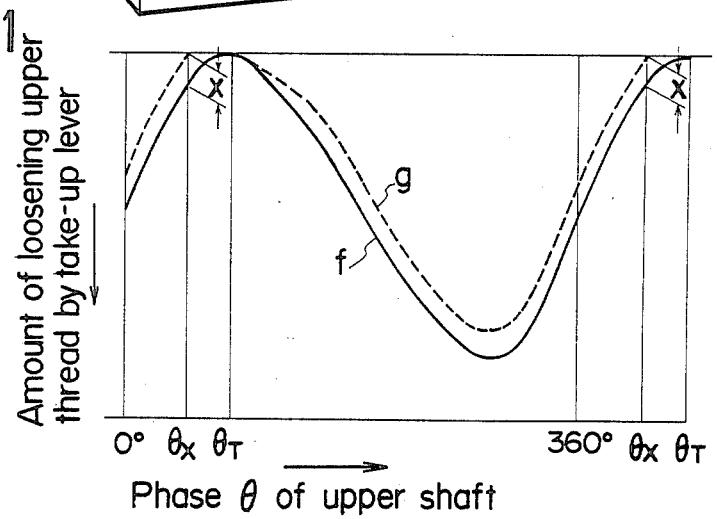

In FIG. 21, a solid curve (f) shows the amount of loosening the upper thread by the take-up lever, and is for a case of forming the stitches which does not substantially require the upper thread at the feed amount 0, zigzag amplitude 0 and fabric thickness 0, and this is basic for referring to loosening of the upper thread by the take-up lever.

On the other hand, a dotted curve (g) shows a case which requires the upper thread by "X", and that the supply of the upper thread is carried out from the thread supply after the phase $\theta$ where the amount of loosening the upper thread of the take-up lever is reduced to said supply amount X. Therefore, if the upper thread control mechanism 103 is released till an upper dead point phase $\theta T$ after the phase $\theta x$, the upper thread 3 is drawn out via the pretension.

The upper thread supply amount is controlled by rendering the electromagnet inoperative, and controlling the interval of the upper shaft rotation phase which releases holding the upper thread 3 between the fixed disc 101 and the movable disc 102. The electromagnet is controlled in accordance with the upper thread supply amount calculated by the program which has been in advance stored in the memory of the micro-computer in dependence upon the information of the lower thread supply amount in addition to the stitching information composed of said fabric sort signal, fabric feed amount signal, needle amplitude amount signal and stitching pattern signal.

(Explanation of actuation)

A 2nd embodiment of the invention will be explained. In FIG. 19, the sewing machine 100 is set with the upper thread, the lower thread and the fabric, and operated are the pattern selecting button 31, the fabric feed amount control lever 27 and the needle amplitude amount control lever 28, and if the sewing machine 100 is input with the stitching information composed of the stitching pattern signal, the fabric feed amount signal, the needle amplitude amount signal and the fabric sort signal from the fabric thickness detecting means, the upper thread supply amount is calculated successively prior to forming each of the stitches, and the interval of the phase is controlled in dependence upon the calculation, which releases the holding or the upper thread by the fixed disc 101 and the movable disc 102. The upper thread 3 of the optimum amount is drawn out by the take-up lever 105, and the lower thread supply amount is calculated prior to forming each of the stitches, and the lower thread supply mechanism 50, 70 or 90 is controlled in dependence upon the calculation and the stitches of automatic thread tension are formed successively.

In the present embodiment, the upper thread supply amount during stitching is calculated into a value (a value of the length of the upper thread required to interlocking with the lower thread at a predetermined position) corresponding to the consumption amount. Tightening of the upper and lower threads is effected by controlling the lower thread supply amount. For the weak tightening of the threads, the lower thread supply amount is calculated in the formula (c) so that the thread tightening amount $\beta$ is 0. For strong tightening of the thread to a certain extent by the stitching information, the lower thread supply amount is calculated in the formula (c) so that the thread tightening amount $\beta$ is one of plus values. While the lower thread is drawn out to a predetermined interlocking position relative to the upper thread, the slacking amount of the lower thread corresponding to the thread tightening amount $\beta$ is drawn out under a condition that the lower thread is effected with tension, so that the stitches of strong tightening to a certain extent can be formed.

, (A 3rd embodiment)

Figure 22:
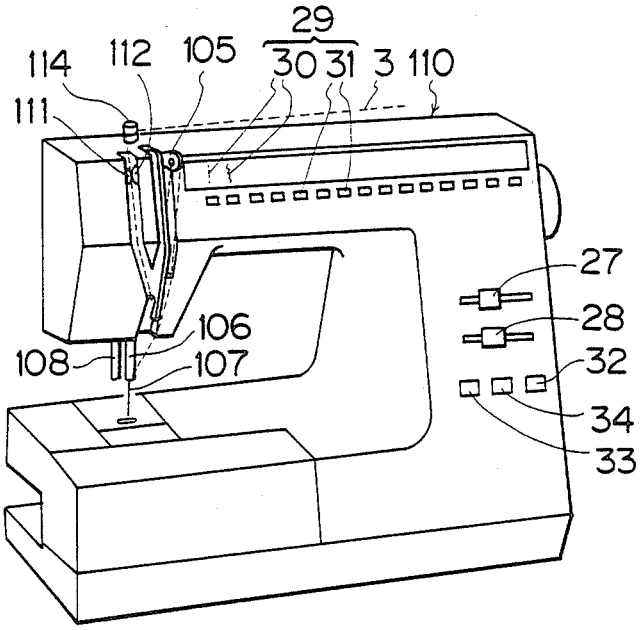

A 3rd embodiment of the invention will be explained. In FIG. 22, a sewing machine 110 has an upper thread control mechanism 113 with a roller 111 of a driving side and a roller 112 of a follower side. The upper thread from a thread supply is guided to a needle 107 attached to a needle bar 106 via a pretension 114, an upper thread control mechanism 113, a thread catching spring and a take-up lever 105.

A numeral 27 designates a fabric feed amount control lever which is input with a fabric feed amount signal by a sliding operation. 28 is a needle amplitude amount control lever which is input with a needle amplitude amount signal by a sliding operation. 29 is a pattern selecting part having pattern indicators 30 and a plurality of pattern selecting buttons 31 corresponding thereto. A stitching pattern is selected by operating the pattern selecting button 31, and simultaneously a stitching pattern is input. 32 is a manual button, and if a button 33 is pushed after the manual button 32 has been pushed, the stitch of interlocking as seen in FIG. 4 is selected in this embodiment. The button 34 is pushed, the stitch of interlocking as in FIG. 5 is selected, so that the consumption of the lower thread may be saved. When the manual button is pushed, it is released.

The sewing machine 110 is provided with a known fabric thickness detector which, though not shown, detects the fabric machine 110 is set with the fabric, the fabric sort signal is input.

Figure 23:
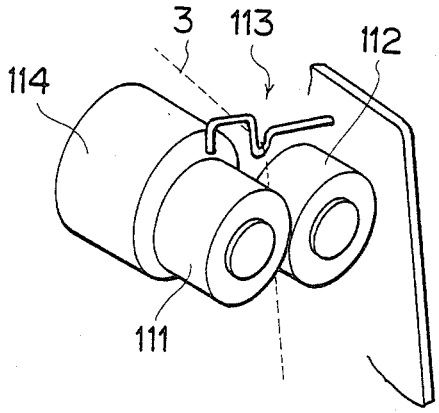
FIGS. 22 and 23 relate to a third embodiment of the invention.

The upper thread control mechanism 113 is, as shown in FIG. 23, provided with a roller 111 of a driving side and a roller 112 of a follower side, said roller 111 being rotated by a stepping motor 114 and said roller 112 being pressed and separated by the roller 111. The upper thread 3 is held between the rollers 111 and 112, and is drawn out by rotation of the stepping motor 114.

(Explanation of actuation)

The 3rd embodiment will be explained. In FIG. 22, the sewing machine 111 is set with the upper thread, the lower thread and the fabric, and operated are the pattern selecting button 31, the fabric feed amount control lever 27 and the needle amplitude amount control lever 28. When the sewing machine 110 is input with the stitching information composed of the stitching pattern signal, the fabric feed amount signal, the needle amplitude amount signal and the fabric sort signal from the fabric thickness detector, the upper thread supply amount is calculated successively prior to forming of stitches per each of forming the stitches. The stepping motor 114 is controlled in dependence upon the calculation, and the upper thread 3 of a required amount is drawn out from the upper thread control mechanism 113. The lower thread 2 is calculated prior to forming of the stitches per each of forming the stitches, and the lower thread mechanism 50, 70 or 90 is controlled in dependence upon the calculation and the stitches of automatic thread tension are formed successively.

In the present embodiment, the upper thread supply amount is calculated into a value (a value of a length of the upper thread to be required to interlocking with the lower thread at a predetermined position) corresponding to the consumption amount. The tightening of the upper and lower threads can be effected by controlling the lower thread supply amount. For the weak tightening, the lower thread supply amount is calculated in the formula (c) so that the thread tightening amount $\beta$ is 0. For the strong tightening to a certain extent, the lower thread supply amount is calculated in the formula (c) so that the tightening amount $\beta$ is one of plus values. While the lower thread is drawn out to a predetermined interlocking position in relation with the upper thread and the stitches are formed, the slacking amount of the lower thread corresponding to the tightening amount $\beta$ is drawn out under the condition that the lower thread is effected with tension, and the stitches of strong tightening to a certain extent can be formed.

As having mentioned above, the lower thread supply amount required to forming the stitches by the stitching information are properly calculated in relation with changing of the needle dropping positions from the preceding stitch to the present one, so that the lower thread is forcibly drawn out in accordance with the calculation, and the optimum upper thread tension for forming the stithes by the stitching information is calculated. In accordance with the calculating results, the invention sets the upper thread tension to the best condition, or calculates the optimum upper thread supply amount for forming the stitches by the stitching information so as to draw out the upper thread. For the normal fabric, the stitches of automatic thread tension by satisfactory tightening may be formed, and for the thin fabric, the force is made weak by tightening the stitches, thereby to cause no shrinkage in the stitches.

What is claimed is:

1. A device for automatically regulating upper and lower thread tension of a zigzag sewing machine that has a machine needle, a loop taker, a bobbin carrier arranged within the loop taker, a bobbin arranged in the bobbin carrier, an upper thread supply, an upper thread extending from the upper thread supply to the machine needle, a lower thread cooperating with the upper thread to form stitches in a fabric to be sewn and being wound around the bobbin and extendable to the fabric from the bobbin, feed dog means for feeding an amount of the fabric with respect to the needle along a fabric feeding direction, a needle plate with a needle dropping hole elongated transverse of the fabric feeding direction, a plurality of thread guides including means for adjustably tensioning the upper thread and a thread take-up lever, a memory storing data indicative of different thicknesses of fabrics to be sewn and pattern data for controlling present and subsequent needle positions and the fabric feeding amount of the feed dog means to form a selected stitch pattern, and pattern selecting means for designating pattern data stored in the memory and including pattern selection switches selectively designating a corresponding selected one of the pattern data stored in memory, the upper thread adjustable tensioning means including at least two discs receiving the upper thread therebetween, spring means for pressing the discs against each other and for pulling the discs apart, and a manually operated dial operable in one direction within a predetermined tension adjusting range to actuate the spring means to progressively increase a pressure being applied to the discs until a maximum tension is applied to the upper thread and also operable in a direction opposite the one direction to actuate the spring means to progressively decrease a pressure being applied to the discs until a minimum tension is being applied to the discs, the loop taker being rotatable in a horizontal plane to catch a loop of the upper thread as the needle comes down through the fabric and the needle dropping hole to thereby concatenate the upper thread with the lower thread to form a stitch in the fabric, the needle being vertically reciprocable and swingable within a maximum range of the elongated needle dropping hole in a plurality of needle positions, the lower thread extending to the fabric from the bobbin along a path of minimum distance when the needle drops at one end position of the maximum range of the elongated needle dropping hole so that a distance of the path progressively increases to a maximum as the needle drops toward an opposite end position of the maximum range of the elongated needle dropping hole, the upper and lower tension regulating device comprising:

means (44) for detecting a present position of the manually operated dial (14) within the predetermined tension adjusting range, said detecting means producing an electrical signal of a specific value indicative of said present position after detecing said present position, said detecting means being formed so that said specific value of said electrical signal progressively increments when said manually operated dial (14) operates in one direction and said specific value of said electrical signal progressively decrements when said manually operated dial (14) operates in a direction opposite to said one direction;

means (19) for selectively designating a corresponding one of the data stored in the memory indicative of different thicknesses of the fabric to be sewn;

calculating means responsive to the pattern data when selectively designated by the pattern selecting switches and to the data indicative of the different thicknesses of the fabric to be sewn as designated by said selectively designating means (19) for producing an output signal indicative of a value with which the manually operated dial (14) is to be set;

means for comparing said electrical signal produced by said detecting means (44) and said output signal produced by said calculating means to thereafter produce a compared output signal;

optical indicating means (15) including a first indicator (16), a second indicator (17) and a third indicator (18) respectively responsive to said compared output signal when said value of said compared output signal is respectively substantially the same as, less then, and greater than said specific value of said electircal signal produced by said detecting means (44), said optical indicating means being formed to thereby indicate a direction in which the manually operated dial (14) is to be moved for tensioning the upper thread;

swingable means (51) for drawing out the lower thread from the bobbin when said swingable means is moved in one direction, said swingable means being swingably movable between the bobbin and the fabric to be sewn;

regulator means (60) being angularly positionable and connected to said swingable means (51) for regulating movement of said swingable means (51) and thereby regulating an amount of the lower thread being drawn out from the bobbin; and actuator means (64) operatively connected to said regulator means (60) for angularly positioning said regulator means (60), said calculating means being responsive to the data indicative of a present position of the needle and a subsequent position of the needle to produce an output for controlling said actuator means.

2. The device as defined in claim 1, wherein said actuating means includes a stepping motor.

3. The device as defined in claim 1; wherein the data stored in memory includes data representing different types of the upper threads to be used; further comprising:

means (23) selectively designating a corresponding one of the data stored in the memory representing different types of the upper threads to be used, said calculating means being responsive to said data designated by said selectively designating means (23) in addition to the operation of the pattern selection switches to produce an output signal having a value with which the manually operated dial is to be set.

4. The device as defined in claim 1; further comprising:

another set of manually operably switches (32, 33, 34) selectively designating a corresponding one of data stored in memory, said calculating means being responsive to data as designated by said another set of manually operable switches to thereby produce an output for modifying an operation of said actuator means.

5. A device for automatically regulating upper and lower thread tension of a zigzag sewing machine that has a machine needle, a loop taker, a bobbin carrier arranged within the loop taker, a bobbin arranged in the bobbin carrier, an upper thread supply, an upper thread extending from the upper thread supply to the machine needle, a lower thread cooperating with the upper thread to form stitches in a fabric to be sewn and being wound around the bobbin and extendable to the fabric from the bobbin, feed dog means for feeding an amount of the fabric with respect to the needle along a fabric feeding direction, a needle plate with a needle dropping hole elongated transverse of the fabric feeding direction, a plurality of thread guides including means for adjustably tensioning the upper thread and a thread take-up lever, a memory storing data indicative of different thicknesses of fabric to be sewn and pattern data for controlling present and subsequent needle positions and the fabric feeding amount of the feed dog means to form a selected stitch pattern, and pattern selecting means for designating a corresponding one of the pattern data stored in the memory and including pattern selection switches selectively designating a corresponding one of the pattern data stored in the memory, the upper thread adjustable tensioning means including at least two discs receiving the upper thread therebetween, spring means for pressing the disks against each other and for pulling the disks apart, and an upper thread tension actuating member operable in one direction within a predetermined tension adjusting range to actuate the spring means to progressively increase a pressure being applied to the discs until a maximum tension is applied to the upper thread and also operable in a direction opposite the one direction to actuate the spring means to progressively decrease a pressure being applied to the discs until a minimum tension is being applied to the discs, the loop taker being rotatable in a horizontal plane to catch a loop of the upper thread as the needle comes down through the fabric and the needle dropping hole to thereby concatenate the upper thread with the lower thread to form a stitch in the fabric, the needle being vertically reciprocable and swingable within a maximum range of the elongated needle dropping hole in a plurality of needle positions, the lower thread extending to the fabric from the bobbin along a path of minimum distance when the needle drops at one end position of the maximum range of the elongated needle dropping hole so that a distance of the path progressively increases to a maximum as the needle drops toward an opposite end position of the maximum range of the elongated needle dropping hole, the upper and lower tension regulating device comprising:

means (44) for detecting a present position of the upper thread tension actuating means, said detecting means producing a detection signal indicative of said present position;

means (19) for selectively designating a corresponding one of the pattern data stored in the memory indicative of different thicknesses of the fabric to be sewn;

signalling means (15) responsive to a selected one of the pattern data as selected by the pattern selecting switches and to a designated one of the pattern data as designated by said selectively designating means (19) and to said detection signal for producing an output signal indicative of a direction with which the upper thread tension actuating member is to be moved for tensioning the upper thread to form the stitch;

swingable means (51) for drawing out the lower thread from the bobbin when said swingable means (51) is moved in one direction between the bobbin and the fabric to be sewn;

regulator means (60) angularly positionable and connected to said swingable means (51) for regulating movement of said swingable means (51) and thereby regulating an amount of the lower thread being drawn out from the bobbin; and actuator means (64) operatively connected to said regulator means (60) for angularly positioning said regulator means (60), said actuating means (64) being responsive to the data indicative of a present position of the needle and a subsequent position of the needle.

6. The device as defined in claim 5, wherein said signalling means includes optical indicating means (15).

* * * * *